United States Patent [19]

Johnson

[11] Patent Number: 4,580,862

[45] Date of Patent: Apr. 8, 1986

[54] FLOATING COAXIAL CONNECTOR

[75] Inventor: Erlon F. Johnson, Elizabethtown, Pa.

[73] Assignee: AMP Incorporated, Harrisburg, Pa.

[21] Appl. No.: 593,454

[22] Filed: Mar. 26, 1984

[51] Int. Cl.[4] ..... H01R 21/28; H01R 17/18

[52] U.S. Cl. ..... 339/64 R; 339/177 R

[58] Field of Search ..... 339/64 R, 64 M, 177 R, 339/177 E, 101

[56] References Cited

U.S. PATENT DOCUMENTS

| | | | |
|---|---|---|---|
| 2,279,265 | 4/1942 | Judisch | 339/107 |
| 3,091,748 | 5/1963 | Takes et al. | 339/177 R |
| 3,094,364 | 6/1963 | Lingg | 339/64 |
| 4,227,765 | 10/1980 | Neumann et al. | 339/177 E |

*Primary Examiner*—Gil Weidenfeld
*Assistant Examiner*—Gary F. Paumen
*Attorney, Agent, or Firm*—AMP Incorporated

[57] ABSTRACT

According to the present invention, an electrical plug connector is mountable onto a panel member for matable connection with an electrical receptacle connector mounted on another panel member when the panel members are moved relative to one another. The plug connector includes a mounting member for mounting to the panel member and it has a hole therein. A plug body member includes a contact section, a terminating section and an intermediate section; the intermediate section is disposed in the hole, and the hole has a diameter larger than the intermediate section. A stop member extends outwardly from the intermediate section, and a spring member is disposed between the mounting member and the body member to normally maintain the stop member against the mounting member and to floatingly mount the body member to the mounting member so that the body member can move axially, radially and on a bias when the contact section matably engages a complementary contact section of the receptacle connector during movement of the panel members relative to one another.

11 Claims, 3 Drawing Figures

FLOATING COAXIAL CONNECTOR

FIELD OF THE INVENTION

This invention relates to electrical connectors and more particularly to floating connectors and especially floating coaxial connectors.

BACKGROUND OF THE INVENTION

Coaxial connectors are used in racks and panels which are electrically connected when the panels are in a closed position in the racks. Such connectors are blind mated and do not need retaining members to retain them in a connected condition, but it is desirable to float mount the plug or the receptacle while fixedly mounting the other so that they can readily mate with one another when the panels are moved to their closed positions in the racks. This compensates for tolerance variations between the racks and panels, the plugs and receptacles and the mounting of the plugs and receptacles to the respective racks and panels.

U.S. Pat. No. 3,091,748 discloses a coaxial plug that is floatingly mounted onto a panel so that the coaxial plug electrically connects with a coaxial receptacle that is fixedly mounted onto a rack. A spring enables the coaxial plug body to move in an axial direction relative to a mounting collar and the mounting collar is floatingly mounted onto the panel so that the entire coaxial plug moves in a radial direction normal to the axial direction of the plug body. The plug body is not floatingly mounted so as to permit it to move axially, radially and at an angle relative to its axis to electrically connect with the coaxial receptacle when the panel is moved to a closed position within the rack.

SUMMARY OF THE INVENTION

According to the present invention, an electrical plug connector is mountable onto a panel member for matable connection with an electrical receptacle connector mounted on another panel member when the panel members are moved relative to one another. The plug connector includes a mounting member for mounting to the panel member and it has a hole therein. A plug body member includes a contact section, a terminating section and an intermediate section; the intermediate section is disposed in the hole, and the hole has a diameter larger than the intermediate section. A stop member extends outwardly from the intermediate section, and a spring member is disposed between the mounting member and the body member to normally maintain the stop member against the mounting member and to floatingly mount the body member to the mounting member so that the body member can move axially, radially and on a bias when the contact section matably engages a complementary contact section of the receptacle connector during movement of the panel members relative to one another.

DETAILED DESCRIPTION OF THE INVESTION

Figure 1:
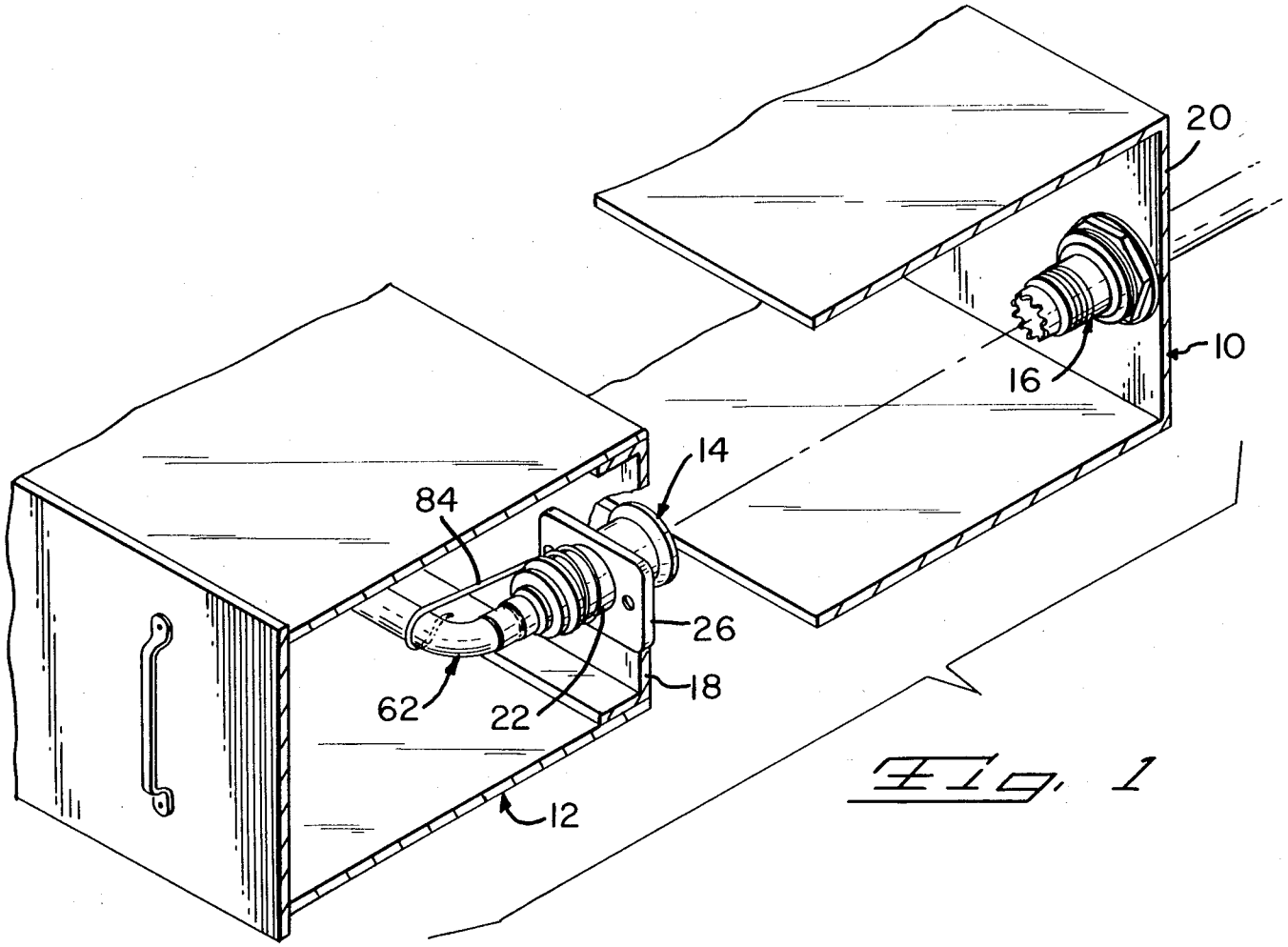
FIG. 1 is an exploded, perspective view in cross section showing rack and panel members on which are respectively mounted matable coaxial plug and receptacle connectors.

FIG. 1 shows a panel member 10 and a rack member 12 in the form of a drawer that is moved into panel member 10 so that an electrical plug connector 14 mounted on rack member 12 electrically connects with electrical receptacle connector 16 mounted on panel member 10 when rack member 12 is moved relative to panel member 10. Electrical plug 14 is floatingly mounted on a rear wall 18 of rack member 12 whereas electrical plug connector 16 is rigidly mounted on a rear wall 20 of panel member 10 so that when rack member 12 is moved into panel member 10 electrical plug connector 14 will readily and easily mate with electrical connector 16 to compensate for tolerance variations between panel member 10 and rack member 12, electrical plug connector 14 and electrical receptacle connector 16 and the mounting thereof onto walls 18 and 20. In this way electrical plug connector 14 can blindly mate with electrical receptacle connector 16 and no retaining means is needed to maintain these connectors in electrical engagement.

Figure 2:
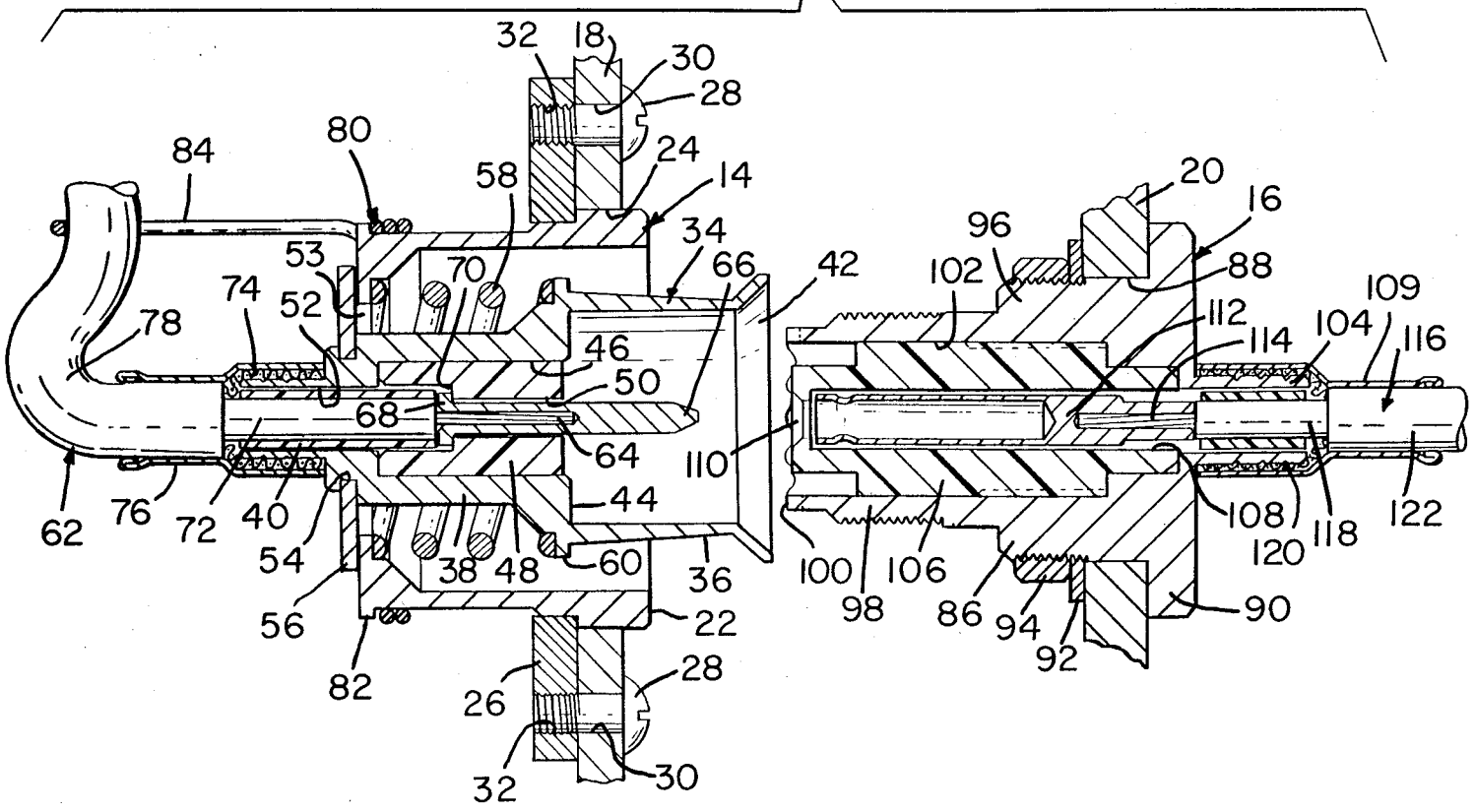
FIG. 2 is a cross section of FIG. 1 taken on a plane passing through the connectors.
Figure 3:
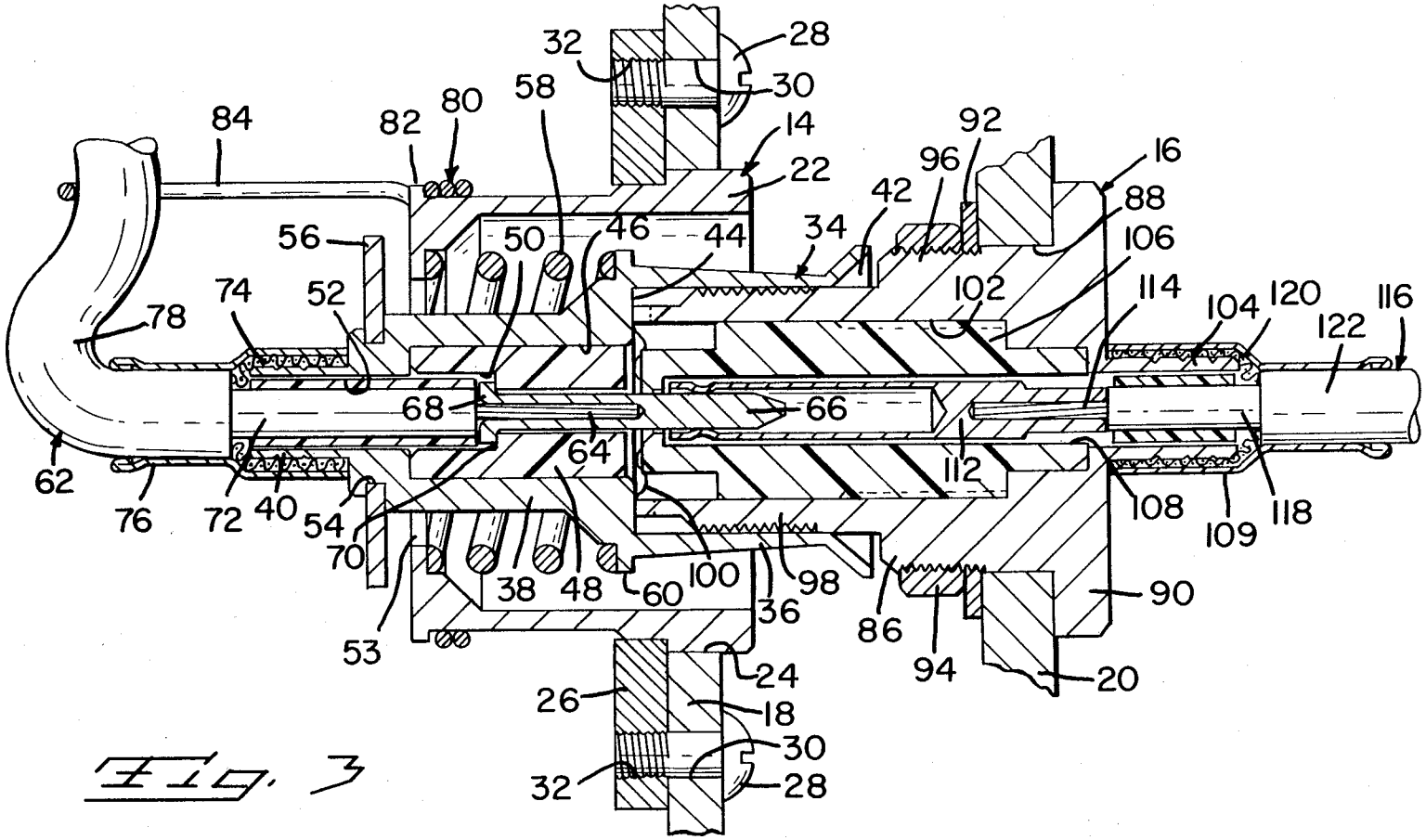
FIG. 3 is a view similar to FIG. 2 showing the connectors in a mated condition.

Electrical plug connector 14 comprises a cup-shaped mounting member 22 which has its front end extending through a hole 24 in wall 18 as shown in FIGS. 2 and 3. A mounting flange 26 is secured to mounting member 22 and is secured to wall 18 via screws 28 extending through holes 30 in wall 18 and threadably engaged with threaded holes 32 in flange 26. Thus, mounting member 22 is securely mounted in hole 24 in wall 18 via mounting flange 26 in engagement therewith.

Plug body member 34 includes a contact section 36, an intermediate section 38 and a terminating section 40. The front end of contact section 36 flares outwardly so as to provide a beveled surface 42 to guide receptacle connector 16 into contact section 36 when plug connector 14 mates therewith. A contact surface 44 is located at the inner end of contact section 36 against which receptacle connector 16 electrically engages. A bore 46 is located in intermediate section 38 and in which is secured a dielectric member 48; dielectric member 48 being secured in bore 46 by staking parts of contact surface 44 thereover. Dielectric member 48 has a step bore 50 extending therethrough. Bore 46 in intermediate section 38 is in communication with bore 52 which is smaller is diameter than bore 46 and extends through terminating section 40. Intermediate section 38 extends through hole 53 in mounting member 22 and the diameter of hole 53 is greater than the diameter of intermediate section 38. An angular grove 54 is located in intermediate section 38 and receives therein a retaining clip 56. A coil spring surrounds intermediate section 38 and is disposed between an inner surface of mounting member 22 and an annular flange 60 located at the juncture between contact section 36 and intermediate section 38 in order to bias plug body member 34 so as to normally maintain retaining clip 56 in engagement with the outside surface of mounting member 22 as shown in FIG. 2. This arrangement enables plug body member 34 to be moveable axially and radially relative to mounting member 22 as well as to be movable at an angle or bias relative to the longitudinal axis of plug connector 14 when mating with receptacle connector 16.

A stripped end of coaxial cable 62 has its center conductor 64 crimped onto center contact member 66 when is then inserted into stepped bore 50 of dielectric member 48 with angular flange 68 of center contact member 66 engaging a stop surface 70 in stepped bore 50 to limit the movement of center contact member 66 therein. Insulating sheath 72 of cable 62 is partly disposed within stepped bore 50 of dielectric member 48 and extends along bore 52 of terminating section 40. Outer conductor 74 in the form of a metallic braid is positioned onto the exterior surface of terminating section 40 and is crimped thereto by ferrule member 76 which is also crimped onto insulating jacket 78 of cable 62 to form a strain relief therewith.

Positioning member 80 in the form a spring has several coils thereof springably engaging an outer surface of mounting member 22 and is retained in position thereon by a flange 82 so that positioning member 80 can be angularly oriented as well as axially positioned on mounting member 22 as desired. A hook member 84 of positioning member 80 extends outwardly from mounting member 22 and cable 62 is hooked into hook member 84 so as to orient cable 62 at an angular orientation relative to the axis of plug connector 14 as shown in the drawings. Hook member 84 can also be bent at an angle relative to the axis of mounting member 22 depending on the position that cable 62 is to be maintained relative to plug connector 14.

Receptacle connector 16 includes a metal body member 86 that is positioned in a hole 88 in wall 20 with a flange 90 engaging against wall 20. A washer 92 is disposed against an opposite side of wall 20 and a nut 94 is threadly mounted on threaded section 96 of body member 86 to secure connector 16 in position on wall 20. A contact section 98 is disposable within contact section 36 of plug body member 34 and has a serrated front surface 100 that is electrically engageable with contact surface 44 of contact section 36 as shown in FIG. 3.

A stepped bore 102 extends through body member 86 with the smaller diameter section of bore 102 extending through terminating section 104. A dielectric member 106 is frictionally secured in bore 102 and it has a bore 108 therein which has a diameter substantially the same as the diameter of the section of stepped bore 102 that extends through terminating section 104. A hole 110 having a beveled entrance is located in the front of dielectric member 106 and is in communication with bore 108. A center contact member 112 is crimped onto an exposed end of center conductor 114 of a stripped end of coaxial cable 116 and the crimped contact member is positioned in bore 108 of dielectric member 106 with insulating sheath 118 being disposed in the bore of terminating section 104 while exposed outer conductor in the form of a metal braid 120 is positioned on the outer surface of terminating section 104 and a ferrule member 109 is crimped onto terminating section 104 as well as onto insulating jacket 122 of coaxial cable 116.

With electrical plug connector 14 secured in position on rack member 12 and electrical receptacle connector 16 secured in position on panel member 10, when rack member 12 moves relative to panel member 10, electrical plug connector 14 electrically mates with electrical receptacle connector 16 and plug body member 34 is able to readily contact with body member 86 so that the outer contact members and center contact members thereof will be electrically connected with one other as shown in FIG. 3. This is accomplished by plug body member 34 being floatingly mounted within mounting member 22 by means of hole 53, retaining clip 56, coil spring 58, and annular flange angular plane 60 thereby enabling body member 34 to move axially, and radially and at an angle with respect to the axis of connector 14 to compensate for the manufacturing tolerances of panel member 10, rack member 12, plug connector 14, and receptacle connector 16 in addition to the mounting of plug connector 14 and receptacle connector 16 to respective rack member 12 and panel member 10.

I claim:

1. A connector assembly for a conductor cable, comprising; a connector body member, at least one contact member in the connector body member for connection with a corresponding conductor of a conductor cable, a mounting member, a wall on the mounting member, first mounting means for mounting the connector body member within the mounting member and to the wall and for mounting the connector body member for movement along its axis and transversely of its axis and angularly of its axis and with respect to the mounting member, and second mounting means projecting from the mounting member for mounting against a second wall and to align the connector body member with an opening in the second wall.

2. A connector assembly for a conductor cable according to claim 1, wherein, the second mounting means is a mounting flange.

3. A connector assembly for a conductor cable according to claim 1, wherein, the mounting member defines a clearance space encircling the connector body member within which the connector body member is moveable with respect to its axis.

4. A connector assembly for a conductor cable according to claim 1, wherein, the first mounting means comprises, an opening in the wall receiving the body member, spring engaging means on the connector body member, spring means on the connector body member and partially compressed between the spring engaging means and the wall, and retainer means on the connector body member seated against the wall.

5. A connector assembly for a conductor cable according to claim 4, wherein the mounting member defines a clearance space encircling the connector body member and within which the connector body member is moveable with respect to its axis.

6. A connector assembly for a conductor cable according to claim 1, wherein, the mounting member is in the form of a cup and the wall is a portion of the cup.

7. A connector assembly for a conductor cable comprising; a connector body member having a front end extending in a forward direction for engagement with a complementary connector assembly, at least one contact member in the connector body member for connection with a corresponding conductor of a conductor cable, a mounting member encircling the connector body member and defining a clearance space within which the connector body member is moveable, a compressible spring surrounding the connector body member and resiliently biasing the connector body member for movement in a forward direction, retaining means on the connector body member for limiting movement of the connector body member in a forward direction, first mounting means including the retaining means and the spring for mounting the connector body member solely to a portion of the mounting member, and second mounting means for engaging against a wall and for aligning the connector body member with an opening in the wall.

8. A connector assembly for a conductor cable according to claim 7, wherein a mounting wall is provided on the mounting member, an opening is provided in the mounting wall and receives the connector body member, the retaining means is seated against the mounting wall, and the spring engages an opposite side of the mounting wall.

9. A connector assembly for a conductor cable according to claim 7, wherein, the connector body member has a section extending in a rearward direction and connecting with a corresponding second conductor of a conductor cable.

10. A connector assembly for a conductor cable according to claim 7, wherein, the mounting member is in the form of a cup, and the mounting wall is a portion of the cup.

11. The connector assembly for a conductor cable according to claim 8, wherein, the mounting member is in the form of a cup, and the mounting wall is a portion of the cup.

* * * * *